United States Patent [19]

Doll

[11] Patent Number: 4,739,686

[45] Date of Patent: Apr. 26, 1988

[54] APPARATUS FOR HOLDING A HARMONICA

[76] Inventor: Michael Doll, 2604 Center Rd., Everett, Wash. 98204

[21] Appl. No.: 37,945

[22] Filed: Apr. 13, 1987

[51] Int. Cl.[4] ..... G10G 5/00

[52] U.S. Cl. ..... 84/379

[58] Field of Search ..... 84/379

[56] References Cited

U.S. PATENT DOCUMENTS 753,713 3/1904 Knode ..... 84/379

923,689 6/1909 Newsam ..... 84/378

FOREIGN PATENT DOCUMENTS 329213 11/1920 Fed. Rep. of Germany ..... 84/379

*Primary Examiner*—Lawrence R. Franklin

*Attorney, Agent, or Firm*—Robert W. Jenny

[57] ABSTRACT

The holder comprises a base adapted to be attached to associated apparatus such as a neck harness and two struts extending from the base and shaped and oriented to hold a harmonica by its ends. The holder fits snugly around the harmonica and the structure from the base to the structure which holds the harmonica approaches the harmonica through a narrow lateral space at the center of the back of the harmonica to enable cupping of the musician's hands around the harmonica.

1 Claim, 1 Drawing Sheet

APPARATUS FOR HOLDING A HARMONICA

BACKGROUND OF THE INVENTION

1. FIELD

The subject apparatus is in the field of apparatuses for supporting musical instruments, particularly harmonicas. More specifically, it relates to the apparatus which holds the harmonica and is attachable to further apparatus well known in the art such as neck harnesses and apparatus adapted to position the harmonica relative to a microphone.

2. PRIOR ART

U.S. Pat. Nos. 3,818,792 and 3,332,310 illustrate examples of harness type apparatus for supporting a harmonica, both apparatuses incorporating means for holding a harmonica. U.S. Pat. No. 4,541,321 shows apparatus for holding a harmonica and positioning it relative to a microphone. It will be obvious to musicians and others skilled in the art that the cited prior art equipment and other equipment commercially available have in common a drawback from a musician's point of view in that the apparatus for holding the harmonica interferes with the cupping of the musician's hand around the instrument in order to enable the attainment of the serious musician's goal of achieving the best possible performance with a given instrument. Attaining this goal also requires that it be possible for the musician to apply force to the harmonica with lips and tongue and this cannot be satisfactorily done with a preponderance of the prior art apparatus.

Therefore, it is an objective of the subject invention to provide a harmonica holder which allows the musician's hands to be cupped around the instrument as freely as with a hand held instrument. It is a further objective that the apparatus hold the harmonica securely enough to allow pressure to be applied to it by the player's tongue and lips. Another objective is that the interaction between the holder and apparatus not cause any squeaks, rattle, clicks and the like. Further objectives are that the apparatus be simple, easy to use, economical and readily adaptable to use with associated apparatus, such as neck harnesses.

SUMMARY OF THE INVENTION

The subject apparatus has a base adapted to be attached to associated apparatus such as neck harnesses for holding harmonicas. Two struts, one right hand and the other left hand, extend from the base. Each strut comprises a first segment and the two first segments lie in a plane and are at a small acute angle to each other. At the end of each first segment there are other segments arranged so that the apparatus first contacts the back of the harmonica and then the bottom, end and top, in that order, of the ends of the harmonica. The first segments are resilient and the apparatus is dimensioned such that the struts must be sprung slightly away from each other in order to accommodate the harmonica. Thus the harmonica is restrained by the spring forces of the struts. The resilience also enables accommodation of harmonicas in a range of conventional shapes and sizes. All of the segments except the first segments are in close proximity to the harmonica and the first segments are close to each other and approach the harmonica near the center of the back. The segments are also oriented so that the first segments do not contact the metal shields on the top and bottom of the harmonica since such contacts tend to produce rattles, squeaks, clicks and the like.

In a preferred embodiment the holder is made of bent wire, the wire being of non-corrosive material or plated with such.

It can be understood from this summary of the invention that it meets its objectives. The musician's hands can be cupped around the instrument. Pressure may be applied by the musician's tongue and lips, the pressure being reacted by the contact of the first segments with the back of the instrument. The resilience of the struts and the avoidance of contacts between the struts and the metal shields prevents squeaks, rattles, clicks and the like. Also, it will be understood by those skilled in the art that the apparatus is simple, easy to use, economical and readily adaptable to use with associated apparatus.

DETAILED DESCRIPTION OF THE INVENTION

Figure 1:
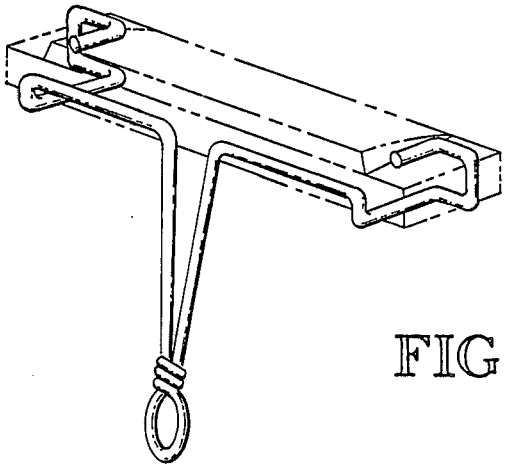
FIG. 1 is a perspective view of the holder with the held harmonica shown in phantom lines.
Figure 2:
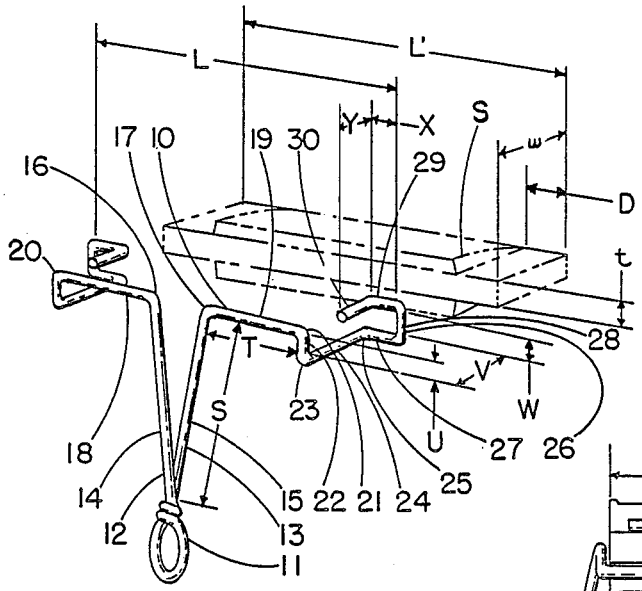
FIG. 2 is a perspective view of the holder with a harmonica shown in phantom lines in a position for insertion into the holder.

As indicated in FIGS. 1 and 2, the holder 10 is made of wire. It comprises loop 11 which forms the base of the holder. The loop is formed by bending the wire into an arc and twisting the wire together for two or more turns. The ends of the wires are then formed into a left hand strut 12 and a right hand strut 13, the struts being mirror images of each other. The struts comprise first segments 14 and 15 which lie in a plane, have a length S. and extend from the base at a small acute angle to each other, to bends 16 and 17 respectively. At these bends the wire is bent so that it lies in the plane of the first segments and extends in one direction from one first segment and in the other from the other segment. The second segments, 18 and 19, or each strut extend a distance T from bends 16 and 17 to bends 20 and 21 and, for the sake of simplicity, from this point on only the right hand strut will be described, the left hand strut being a mirror image. Bend 21 is a 90° bend. A third segment 22 extends a distance U from bend 21 to bend 23, also a 90° bend. Segments 19 and 22 lie in a plane which intersects the plane in which the first segments lie at the centerline of the second segment. These planes are at a small acute angle to each other. The plane of the second and third segments is on the same side of the base as the remainder of the segments.

The fourth segment 24 extends a distance V from bend 23 to bend 25, also a 90° bend. The distance from bend 21 to bend 23 is about one-half the thickness t of the back of the harmonica. The length of the fourth segment is about three-quarters of the width w of the harmonica.

The fifth segment 26 is U-shaped and lies in a plane perpendicular to the fourth segment. Segment 26 comprises leg 27, bottom 28 and leg 29. The length of this segment is just short of the distance D on the harmonica, the distance from the end of shield S to the end of the harmonica. Segments 22 and 24 are in a plane perpendicular to the plane of segment 19 and 22. Segment 24 and leg 27 are in a plane perpendicular to the plane of segments 22 and 24. Legs 27 and 29 are parallel to each other and perpendicular to bottom 28.

The distance W from leg 27 to leg 29 is slightly greater than t, the thickness of the end of the harmonica.

The centerline of the sixth segment 30 is in the plane of the centerlines of segments 22 and 24 and the length of segment 30 is about $\frac{2}{3}$ that of segment 24.

The distance L between bottom 28 on the right hand strut and its counterpart 28' on the left hand strut is somewhat less than length L' of the harmonica.

Figure 3:
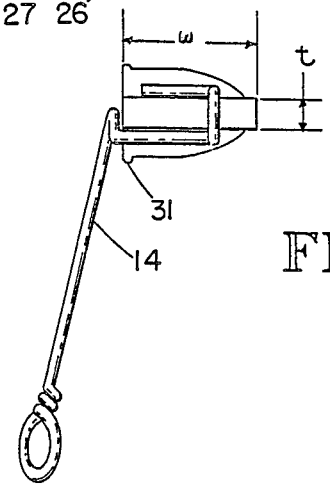
FIG. 3 is an end view of a harmonica (in phantom lines) inserted in the holder.

In use, the base is attached to associated apparatus such as a neck harness and the harmonica is inserted into the holder with the playing edge away from the segments 18 and 19. As shown in FIG. 3, segments 14 and 15 (not visible in this view) clear the metal elements of the harmonica to preclude generation of squeaks, vibration, clicks and the like by contact between those segments and element 31.

It can be seen from this detailed description that the invention meets its objectives. The musician's hands can be cupped around the instrument. Pressure may be applied by the musician's tongue and lips, the pressure being reacted by the contact of the first segments with the back of the instrument. The resilience of the struts and the avoidance of contacts between the struts and the metal shields prevents squeaks, rattles, clicks and the like. Also, it will be understood by those skilled in the art that the apparatus is simple, easy to use, economical and readily adaptable to use with associated apparatus.

A preferred embodiment of the invention is described herein. However, it will be understood by those skilled in the art that variations of this embodiment and other embodiments are possible within the scope of the invention which is limited only by the attached claims.

I claim:

1. Apparatus for holding a harmonica, said apparatus being an integral part and comprising:

a base having an opening, a right-hand strut and left-hand strut supported by said base and extending from it in a first plane and at an acute angle to each other, said struts being resilient, said right-hand strut comprising:

a first segment, lying in said first plane, a second segment at a right angle to said first segment and a distance S from said base and having a centerline, a third segment at a right angle to said second segment and a distance T from said first segment, said second and third segment lying in a second plane, said second plane intersecting said first plane at said centerline of said segment and at an acute angle to said first plane, said right-hand strut further comprising:

a fourth segment, a distance U from said second segment and at right angles to said third segment and lying in a third plane which is perpendicular to said centerline and to said second plane, a fifth U-shaped segment a distance V from said third segment having first and second legs a distance W apart and having a length X, and lying in a fourth plane perpendicular to said third plane and a sixth segment, normal to said fourth plane, parallel to said fourth segment and extending a distance Y from said fifth segment toward said second plane, said left-hand strut being a mirror image of said right-hand strut relative to said base, dimensions T, U, V, W, X and Y being such that said second, third, fourth, fifth and sixth segments fit along the back of and around the ends of a harmonica of conventional dimensions and shape to support said harmonica from said base, said acute angle between said first and second planes being such that said first segments are clear of any and all parts of a supported harmonica, said opening adapting said base and thereby said apparatus to be attached to apparatus known in the art for supporting harmonicas from the necks of musicians or from microphone apparatus.

* * * * *